US006062812A

United States Patent [19]

Ozawa

[11] Patent Number: 6,062,812

[45] Date of Patent: May 16, 2000

[54] LIQUID PUMP

[75] Inventor: Yasuo Ozawa, Kariya, Japan

[73] Assignee: Aisin Seiki Kabushiki Kaisha, Aichi-Pref., Japan

[21] Appl. No.: 09/047,573

[22] Filed: Mar. 25, 1998

[30] Foreign Application Priority Data

Mar. 26, 1997 [JP] Japan ..... 9-073949

[51] Int. Cl.[7] ..... F04D 29/08

[52] U.S. Cl. ..... 415/173.1; 415/170.1; 415/168.2; 415/230

[58] Field of Search ..... 415/170.1, 172.1, 415/168.2, 173.1, 173.3, 174.2, 230

[56] References Cited

U.S. PATENT DOCUMENTS 3,947,147 3/1976 Loktaeva et al. ..... 415/170.1
5,226,787 7/1993 Freeman ..... 415/230

FOREIGN PATENT DOCUMENTS 55-29039 3/1980 Japan .
63-27117 of 1988 Japan .
7-1037 of 1995 Japan .

*Primary Examiner*—Edward K. Look
*Assistant Examiner*—Richard Woo
*Attorney, Agent, or Firm*—Reed Smith Hazel & Thomas, LLP

[57] ABSTRACT

A liquid pump includes a body, a stationary member which is fluid-tightly fixed to the body through a seal plate, a shaft which is rotatably supported on the body and an impeller which is disposed in a vortex chamber formed in the body and having a disk portion fixed to the one end of the shaft and plural blades formed on a side face of the disk portion directed toward the body so as to project toward the body and to extend radially, wherein an extending portion is formed on the seal plate so that a predetermined axial clearance is maintained between the extending portion and end surfaces of the blades directed toward the body.

4 Claims, 2 Drawing Sheets

LIQUID PUMP

BACKGROUND OF THE INVENTION

1. Field of the Invention

The present invention relates to a liquid pump such as a water pump for forcibly circulating an engine cooling liquid such as water by means of a centrifugal force.

2. Description of the Prior Art

A conventional liquid pump of this kind is disclosed, for example, in Japanese Patent Publication No. 7(1995)-1037. This conventional water pump includes a body, a stationary member on which the body is fluid-tightly fixed through a seal member, a shaft which is rotatably supported on the body and an impeller which is fixed to one end of the shaft and which is disposed in a vortex chamber formed in the body. The impeller includes a disk portion which is fixedly fitted on the one end of the shaft at its inner circumference and plural blades which are formed on a side face of the disk portion directed toward the body so as to project toward the body and to extend radially. A stepped portion is formed on the body so as to be located adjacent to the vortex chamber. A partition plate having an inlet port is fixed on the stepped portion so that a predetermined axial clearance is maintained between the partition plate and end surfaces of the blades directed toward the body.

According to this prior pump, since the opening side of the blades directed toward the body is closed by the partition plate, a liquid from the inlet port is satisfactorily forced by centrifugal effects due to the rotation of the impeller. However, since the above prior pump requires the partition plate, the number of the parts not only increases but also a machining process of the stepped portion for fixing the partition plate to the body is required. Further, it is necessary to install the partition plate in addition to the installation of the seal member for assembling the liquid pump. As a result, in the above prior pump, the manufacturing cost of the pump is markedly increased. Further, in the above prior pump, an axial space for installing the partition plate is required and therefore the size of the pump is increased.

If a closing portion which closes the opening side of the blades of the impeller is formed on the impeller itself as disclosed in Japanese Utility-Model Application Laid-Open Publication No. 59(1984)-133798, it is possible tc overcome the above drawbacks. However, for this arrangement, it is difficult to manufacture the impeller having the closing portion and thereby the manufacturing cost of the pump is markedly increased.

SUMMARY OF INVENTION

It is, therefore, an object of the present invention to provide an improved liquid pump which overcomes the above drawbacks.

It is another object of the present invention to provide an improved liquid pump which can obtain a satisfactory pumping effect without increasing the manufacturing cost and increasing the size of the pump.

In order to achieve these objectives, there is provided an improved liquid pump which includes a body, a stationary member fluid-tightly fixed to the body through a seal plate, a shaft rotatably supported on the body and an impeller disposed in a vortex chamber formed in the body and having a disk portion fixed to the one end of the shaft and plural blades formed on a side face of the disk portion directed toward the body so as to project toward the body and to extend radially, wherein an extending portion is formed on the seal plate so that a predetermined axial clearance is maintained between the extending portion and end surfaces of the blades directed toward the body.

BRIEF DESCRIPTION OF THE DRAWINGS

Additional objects and advantages of the present invention will become more apparent from the following detailed description of preferred embodiment thereof when considered with reference to the attached drawings, in which.

DESCRIPTION OF THE PREFERRED EMBODIMENTS

A liquid pump in accordance with a preferred embodiment of the present invention will be described with reference to attached drawings.

Figure 1:
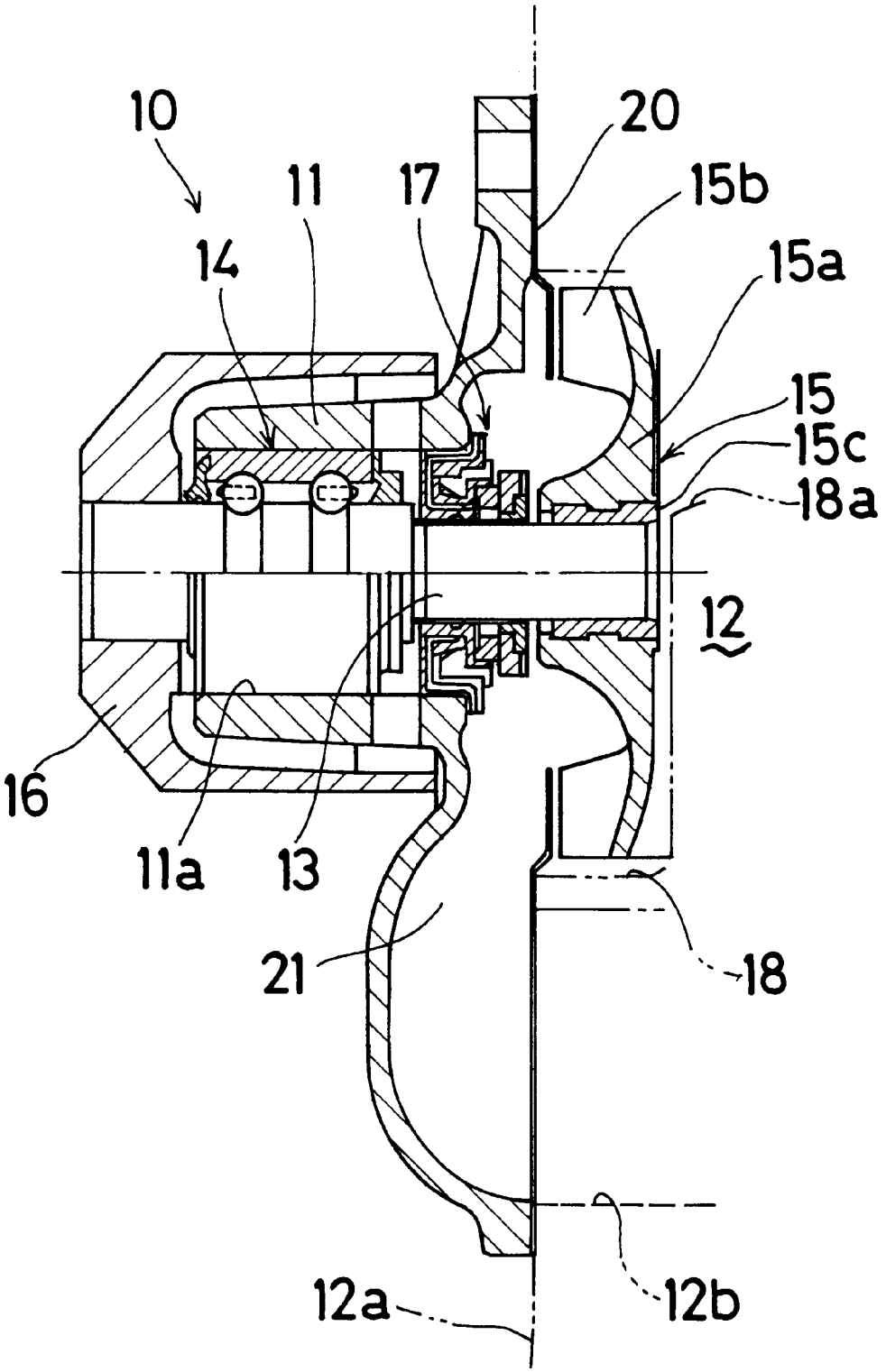
FIG. 1 shows a sectional view of an embodiment of a liquid pump in accordance with the present invention.
Figure 2:
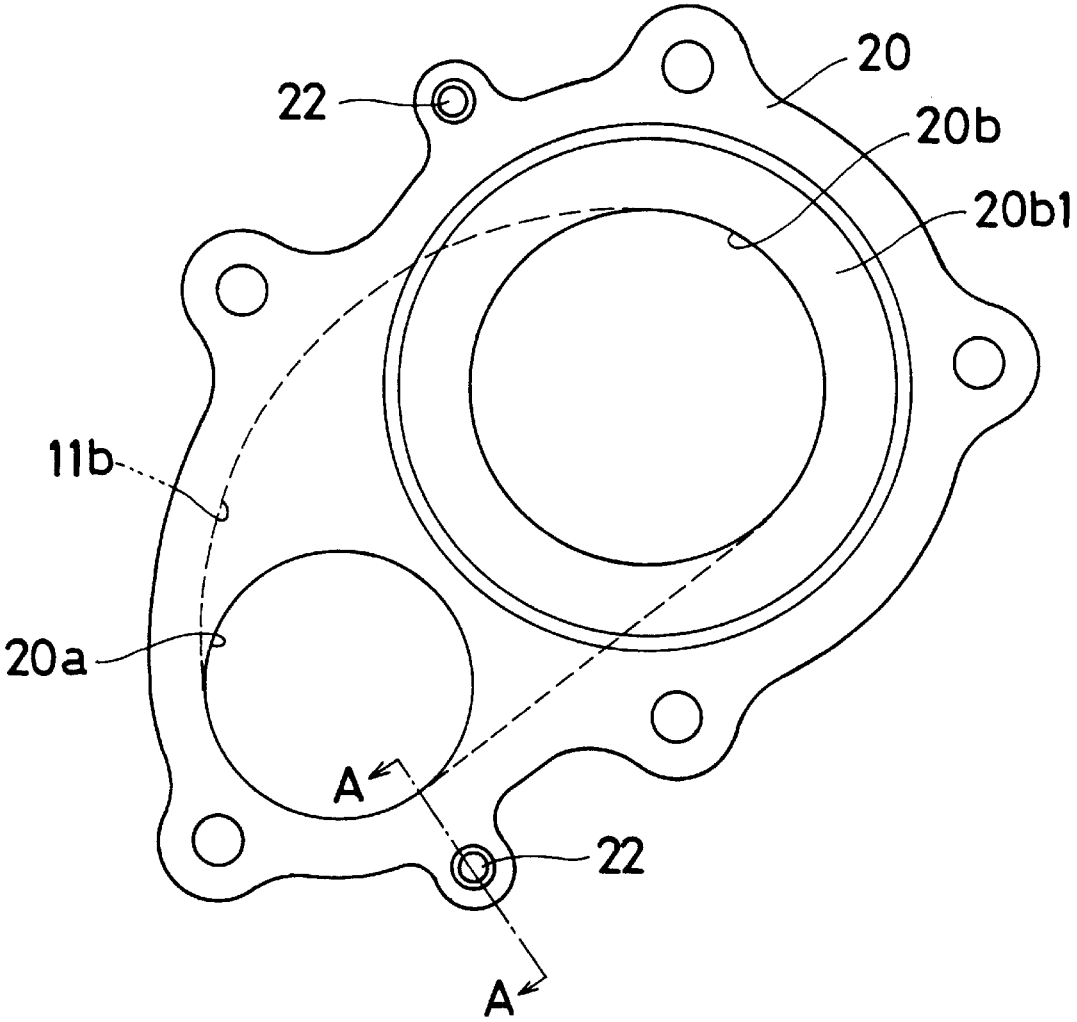
FIG. 2 shows a side view of a body and a metal gasket in FIG. 1.

Referring to FIG. 1 and FIG. 2, a body 11 of a liquid pump 10 such as a water pump for an internal combustion engine includes an inner bore 11*a*.

A shaft 13 is rotatably supported in the inner bore 11*a* through a rolling bearing 14. In this embodiment, the shaft 13 functions also as an inner brace of the rolling bearing 14 which is fixedly pressed into the inner bore 11*a*. An impeller 15 is fixed to one end of the shaft 13 which is projected from the right end of the inner bore 11*a* in FIG. 1. A pulley 16 for connecting to a driving source (not shown), for example, to a crank pulley (not shown) of the engine through a belt (not shown) and so on, is fixed to the other end of the shaft 13 which is projected from the left end of the inner bore 11*a* in FIG. 1.

The body 11 is fluid-tightly fixed to a cylinder block 12 through a thin metal gasket 20. The metal gasket 20 corresponds to a seal plate of the present invention and is comprised of a metal plate made of SUS, SCP, etc., on and an elastic member, such as a rubber, coating the metal plate. The cylinder block 12 corresponds to a stationary member of the present invention and a vortex chamber 18 is formed in the cylinder block 12. The impeller 15 is rotatably disposed in the vortex chamber 18. An outlet passage (not shown) which communicates between an outlet portion 18*a* of the vortex chamber 18 and a water jacket (not shown) is formed in the cylinder block 12.

In this embodiment, the impeller 15 is made of resin and includes a disk portion 15*a* and plural blades 15*b* which are formed on a radially outer end of a side face of the disk portion 15*a* directed toward the body 11 so as to project toward the body 11 and to extend radially. A sleeve 15*c* made of iron or the like is insert-molded in an inner circumference of the disk portion 15*a* and an inner bore of the sleeve 15*c* is fixedly pressed on the one end of the shaft 13. In this embodiment, end surfaces of the blades 15*b* directed toward the body 11 are located at the side of a bottom portion of the vortex chamber 18 in the axial direction with regard to a fixing surface 12*a* of the cylinder block 12 to which the body 11 is fixed.

As shown in FIG. 2, a concave portion 11*b* is formed on an end surface of the body 11 which is directed toward the cylinder block 12. The metal gasket 20 interposed between the body 11 and the cylinder block 12 has a same configuration as that of the end surface of the body 11 which is directed toward the cylinder block 12. The metal gasket 20 includes a first hole 20*a* which communicates with an inlet passage 12*b* formed in the cylinder block 12 and a second hole 20*b* whose circumference 20*b*1 opposes to the end surfaces of the blades 15*b* of the impeller 15 directed toward the body 11 in the axial direction while maintaining a predetermined axial clearance therebetween. The inner diameter of the second hole 20*b* is the same as that of the end surfaces of the blades 15*b* of the impeller 15. Thereby, a liquid passage 21 for introducing the cooling liquid from the inlet passage 12*b* of the cylinder block 12 to the radially inner end of the blades 15*b* through the first and second holes 20*a* and 20) is formed between the concave portion 11*b* of the body 11 and a portion of the metal gasket 20 separating between the first and second holes 20*a* and 20*b*. In this embodiment, in order to prevent the liquid passage 21 from being restricted by the above-mentioned location of the end surfaces of the blades 15*b* directed toward the body 11, the circumference of the second hole 20*b* of the metal gasket 20 is bent so as to be projected into the vortex chamber 18. The circumference of the second hole 20*b* corresponds to an extending portion of the present invention.

Figure 3:
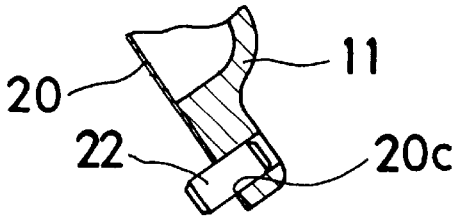
FIG. 3 shows a cross-sectional view taken on line A—A of FIG. 2.

As shown in FIG. 2 and FIG. 3, two nocking pins 22 are fixed on a fixing surface of the body 11 to which the cylinder block 12 is fixed. These nocking pins 22 are fitted into corresponding holes (not shown) formed on the cylinder block 12 so that body 11 is located relative to the cylinder block 12. Further, regulating holes 20*c* are formed at a portion of the metal gasket 20 corresponding to the nocking pins 22, respectively, and the regulating holes 20*c* are tightly fitted on the nocking pins 22. In FIG. 1, a numeral 17 shows a well-known mechanical seal which is disposed between the impeller 15 and the rolling bearing 14 for preventing the cooling liquid from leaking toward the rolling bearing 14.

In the liquid pump having the above structure, when the shaft 13 is rotated by the rotational torque of the engine through the pulley 16, the impeller 15 is rotated in the vortex chamber 18. In this embodiment, since the opening side of the blades 15*b* of the impeller 15 directed toward the body 11 is closed by the circumference 20*b*1 of the second hole 20*b* of the metal gasket 20 so as not to open into the liquid passage 21, it is possible to obtain the satisfactory pumping operation by centrifugal effects due to the rotation of the impeller 15 without using an additional member and without increasing the size of the pump due to the additional member. Further, in this embodiment, the end surfaces of the blades 15*b* directed toward the body 11 are located at the side of a bottom portion of the vortex chamber 18 with regard to a fixing surface 12*a* of the cylinder block 12 to which the body 11 is fixed thereto and the circumference of the second hole 20*b* of the metal gasket 20 is bent so as to be projected into the vortex chamber 18. Thereby, it is possible to decrease the amount of the projection of the pump 10 which is projected from fixing surface 12*a* of the cylinder block 12 without restricting the liquid passage 21. Therefore, it is possible to miniaturize the engine while maintaining the efficiency of the pump 10.

Further, the regulating holes 20*c* are tightly fitted on the nocking pins 22 provided on the body 11 and the metal gasket 20 is fixed to the body I L. Therefore, for example, when the liquid pump 10, which comprises the body 11, the shaft 13, the rolling bearing 14, the impeller 15, the pulley 16 and the mechanical seal 17, is carried before being fixed to the cylinder block 12, collision of the metal gasket 20 with the body 11 is prevented. Thereby, the metal gasket 20 is surely protected from damage by the collision and the primary sealing function of the metal gasket 20 is satisfactorily maintained.

In the above mentioned embodiment, the body 11 is fixed to the cylinder block 12 as the stationary member. However, it is possible to use a cover member having an inlet passage and an outlet passage, which are communicated to the cylinder block, as the stationary member.

According to the present invention, the opening side of the blades 15*b* of the impeller 15 directed toward the body 11 is closed by the extending portion of the thin metal gasket for sealing between the body and the stationary member without using an additional member. Therefore, it is possible to obtain a satisfactory pumping effect without increasing the manufacturing cost and without increasing the size of the liquid pump.

The principles, a preferred embodiment and a mode of operation of the present invention have been described in the foregoing description. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not to limit the scope and spirit of the invention as set forth in the appended claims.

What is claimed is:

1. A liquid pump comprising:

a body, a stationary member fluid-tightly fixed to the body through a seal plate, the seal plate being a metal gasket which includes a metal plate and an elastic member coating the metal plate, a shaft rotatably supported on the body and an impeller disposed in a vortex chamber formed in the stationary member, the impeller having a disk portion fixed to one end of the shaft and plural blades formed on a side face of the disk portion directed toward the body so as to project toward the body and to extend radially, wherein an extending portion is integrally formed on the seal plate so that a predetermined axial clearance is maintained between the extending portion and surfaces of the blades directed toward the body.

2. The liquid pump as claimed in claim 1, wherein the body has a regulating projection and the metal gasket has a regulating hole which is tightly fitted on the regulating projection.

3. The liquid pump as claimed in claim 1, wherein the metal gasket includes a first hole which communicates with an inlet passage formed in le stationary member and a second hole which the extending portion is formed at its circumference opposing to the end surfaces of the blades of the impeller directed toward the body in the axial direction while maintaining a predetermined axial clearance therebetween, and the metal gasket forms a liquid passage between the body and its portion separating the first hole from the second hole.

4. The liquid pump as claimed in claim 3, wherein the end surfaces of the blades directed toward the body are located at the side of a bottom portion of the vortex chamber in the axial direction with regard to a fixing surface of the stationary member to which the body is fixed, and the extending portion is bent so as to be projected into the vortex chamber for preventing restriction of the liquid passage.

* * * * *